United States Patent [19]

Achelpohl et al.

[11] 4,184,627

[45] Jan. 22, 1980

[54] SACK OF PLASTICS MATERIAL WITH INTERNAL FASTENER AND BASE COVERING SHEET AND METHOD OF MAKING SAME

[75] Inventors: Fritz Achelpohl; Richard Feldkämper, both of Lengerich, Fed. Rep. of Germany

[73] Assignee: Windmoller & Holscher, Lengerich, Fed. Rep. of Germany

[21] Appl. No.: 841,757

[22] Filed: Oct. 13, 1977

[30] Foreign Application Priority Data

Oct. 20, 1976 [DE] Fed. Rep. of Germany ..... 2647432

[51] Int. Cl.[2] ..... B65D 33/16

[52] U.S. Cl. ..... 229/60; 93/8 VB; 93/35 SB

[58] Field of Search ..... 229/57, 58, 60; 150/1; 93/8 B, 35 SB

[56] References Cited

U.S. PATENT DOCUMENTS

| | | | |
|---|---|---|---|
| 2,046,077 | 6/1936 | Johnson | 229/58 |
| 3,237,534 | 3/1966 | Lissner | 229/60 |

FOREIGN PATENT DOCUMENTS

| | | | |
|---|---|---|---|
| 1397319 | 3/1965 | France | 229/58 |
| 1545966 | 11/1968 | France | 229/58 |

*Primary Examiner*—Stephen P. Garbe

*Attorney, Agent, or Firm*—Fleit & Jacobson

[57] ABSTRACT

A sack made from a tube of plastics material has its bottom constructed by folding an end portion of the tube so as to form two coplanar substantially isosceles triangular flattened portions with spaced confronting bases defined by plain edges and sides defined by fold lines. The space between the bases is bridged by a strip of material that overlaps the bases of the triangles and also projects beyond the base angles of the triangles. The projecting ends of the strip are folded over and the strip is welded to the sack bottom by seams which intersect at the fold lines.

6 Claims, 4 Drawing Figures

SACK OF PLASTICS MATERIAL WITH INTERNAL FASTENER AND BASE COVERING SHEET AND METHOD OF MAKING SAME

The invention relates to a plastics sack which is made from a tube section and of which the base consists of corner folds formed by pulling the end of the tube section open, an internal fastener which partially covers the corner folds, and a base covering sheet adhered over the folded side flaps of the base, and to a method of making same.

Sacks of this kind can be made in a simple manner from plastics film by welding the internal fastener to the end of the tube that has been shaped to form a base, the bases being capable of withstanding high loads and also being dust and waterproof. In recent times, however, large sack-like containers have been used which consist of a fabric woven from plastics threads or tapes and coated on one side or laminated on one side with plastics film. To form the base of such sacks, the internal fastener is, after the square base has been pulled open, simply and sealingly welded to the corner folds in known manner. However, between the corner folds the internal fastener lies on the uncoated fabric on the inside of the pulled-open tube end and this does not permit a secure and sealed welding connection to be obtained for the internal fastener.

It is therefore the problem of the invention to provide a sack which is made from a tube section of fabric oven from plastics threads or tapes having its outside coated or laminated with a plastics film, the sack having a sealed and secure base.

In a sack made from a woven tube section of plastics threads or tapes and coated on the outside or laminated on the outside with a plastics film, this problem is solved according to the invention in that the internal fastener projects beyond the square base in the region between the corner folds, is turned over onto the outer sides of the tube wall and is connected to the corner folds and the outer sides by weld seams extending at right-angles to one another, and that the weld seams intersect at the folded edges of the corner folds. In the sack according to the invention, the internal fastener is welded to the coated or laminated outer faces of the tube section which are very suitable for welding, so that a tight and strong sack is produced.

A method of making the sack according to the invention, in which the end of a tube section is pulled open to form a square base, an internal fastener is welded in, the base is closed by folding the side flaps over and a base covering sheet is stuck on, is characterised according to the invention in that an internal fastener projecting beyond the square base is turned over onto the outer sides of the tube walls at least in the region between the corner folds and is welded to the corner folds and the outer sides in a manner such that the weld seams intersect on the folded edges of the corner folds.

An example of the invention will now be described in more detail with reference to the drawing, wherein.

Figure 1:
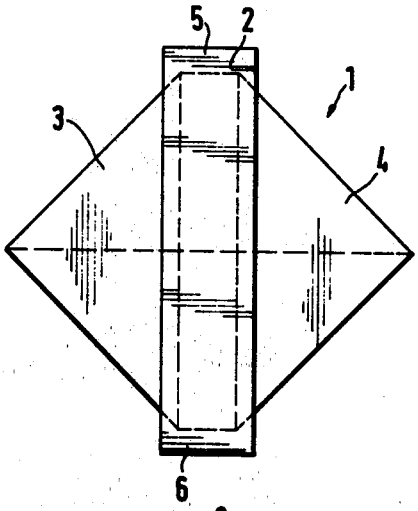
FIG. 1 is a plan view of a tube section which has been pulled open to form a square base and on which an internal fastener has been laid.
Figure 2:
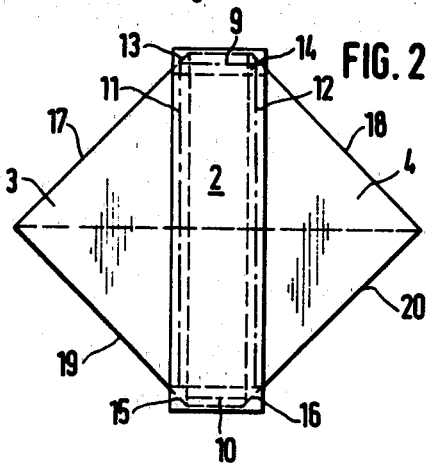
FIG. 2 is as FIG. 1; its portions projecting beyond the square base have been folded over onto the outside of the tube and there welded.
Figure 3:
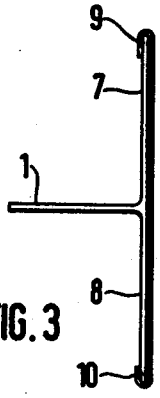
FIG. 3 is a side elevation of FIG. 2.
Figure 4:
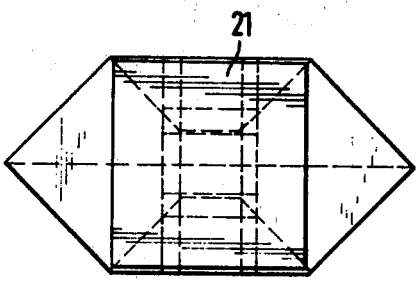
FIG. 4 shows a closed base covered with a base covering sheet.

A section 1 of a tube woven from plastics threads or tapes and coated on the outside or laminated on the outside with a plastics film is pulled open to form a square base and an internal fastener 2 is placed thereon. It covers the corner folds 3, 4 and has portions 5, 6 projecting beyond the square base in the region between the corner folds. As will be evident from FIGS. 2 and 3, the portions 5, 6 are folded onto the outer sides 7, 8 of the tube and welded thereto by weld seams 9, 10. Weld seams 11, 12 which connect the corner folds 3, 4 to the internal fastener 2 intersect the weld seams 9, 10 at intersections 13 to 16 which lie on the folded edges 17 to 20 of the corner folds 3, 4. This produces a tight and high-strength connection of the internal fastener to the tube section. After closing, a base covering sheet 21 is stuck on as shown in FIG. 4.

We claim:

1. A plastic sack which is made from a tube section and of which the base comprises side flaps defined by corner folds formed by pulling an end of the tube section open, an internal fastener which partially covers the corner folds, and a base covering sheet adhered over side flaps of the base that are folded after the internal fastener is applied, characterized in that in a sack made from a woven tube section of plastics threads or tapes and coated on the outside or laminated on the outside with a plastics film, the internal fastener (2) projects beyond a square base defined by the corner folds in a region between the corner folds (3, 4), is turned over onto the outer sides (7, 8) of the wall of the tube section and is connected to the corner folds (3, 4), and the outer sides (7, 8) by weld seams (9 to 12) extending at right-angles to one another, the weld seams being positioned in such manner that the internal fastener is connected only to exterior surfaces of the tube section and that the weld seams (9 to 12) intersect at the folded edges (17 to 20) of the corner folds (3, 4).

2. A plastics sack comprising:

a circular tube section formed of woven plastics material having a plastics film positioned on its outer surface and having one end shaped to define a generally square-shaped tube base with a bottom surface facing away from and a top surface facing towards said circular tube, said one end being shaped by pulling apart and folding two portions of said one end to define triangular-shaped corner folds having spaced-apart parallel bases and side edges defined by folded portions of said one end, the ends of the bases of the corner folds being joined by parallel portions of said one end thereby defining a generally square-shaped tube base;

an internal fastener welded to said tube base and having:

(a) longitudinally-extending edge portions welded to respective ones of said corner folds by a pair of first weld lines, each of said first weld lines extending between side edges of respective ones of said corner folds, and (b) end portions folded over said parallel portions of said one end and welded to the top surface of said tube base by a pair of second weld lines positioned in such manner that respective ends of said second weld lines meet ends of said first weld lines at said corner folds, said pairs of weld lines connecting said internal fastener only to the plastics film positioned on the woven plastics material; and a base covering sheet adhered to the bottom surface of said base, said parallel portions of said one end being folded onto the bottom surface prior to said base covering sheet being adhered to said base so that said base covering sheet covers said pair of second weld lines.

3. A plastics sack as claimed in claim 2 wherein said pair of first weld lines are parallel to said bases of said corner folds.

4. A plastics sack as claimed in claim 3 wherein said corner folds have the same dimensions and wherein said pair of first weld lines are equally spaced from said bases of said corner folds.

5. A method of making a sack from a woven tube section of plastics material having a plastics film on its outer surface comprising:

pulling open the end of a tube section to form spaced-apart corner folds having folded edges defining a square base;

welding an internal fastener to the square base;

closing the base by folding over portions of the base; and adhering a base covering sheet to the closed base, the internal fastener being welded only to the plastics film on the woven tube section in such manner that ends of the fastener project beyond the square base and are turned over and welded onto the outer sides of walls of the tube section at least in the region between the corner folds in a manner such that the weld seams welding the internal fastener to the square base intersect on the folded edges of the corner folds, the points where the weld seams intersect being included in the folded over portions of the base.

6. A method according to claim 5 wherein the internal fastener is welded to the square base by intersecting parallel weld lines.

* * * * *